United States Patent [19]

Stahnke

[11] 4,307,648

[45] Dec. 29, 1981

[54] METHOD AND APPARATUS FOR MEASURING THE DYNAMICS OF A PIANO PERFORMANCE

[76] Inventor: Wayne L. Stahnke, 11434 McCune Ave., Los Angeles, Calif. 90066

[21] Appl. No.: 196,190

[22] Filed: Oct. 14, 1980

[51] Int. Cl.[3] ..... G10G 3/04

[52] U.S. Cl. ..... 84/462; 84/254; 84/463

[58] Field of Search ..... 84/147, 243, 254, 261–263, 84/470–471, 475, 477–478

[56] References Cited

U.S. PATENT DOCUMENTS

| | | | |
|---|---|---|---|
| 1,948,996 | 2/1934 | Toulon | 84/423 |
| 2,555,071 | 5/1951 | Worch | 84/22 |
| 2,946,252 | 7/1960 | Clark | 84/423 |
| 3,979,990 | 9/1976 | Hinago | 84/423 |

*Primary Examiner*—Lawrence R. Franklin
*Attorney, Agent, or Firm*—Pastoriza & Kelly

[57] ABSTRACT

The dynamics of a piano performance are measured by measuring the dynamics of each individual note played. This measurement is accomplished by measuring the "near terminal velocity" of the hammer shank associated with each note, the velocity determining the "loudness" of the note. In order to make this velocity measurement without affecting appreciably the "feel" of the piano, a notched shutter is secured to the hammer shank for the particular hammer associated with each note for cooperation with an optical switch (light source and photo cell). When any one note is played, the corresponding hammer shank will move upwardly to cause the hammer to strike the appropriate piano string and in the upward movement, the top of the shutter will intercept the optical switch to generate an initiating signal. This initiating signal starts a count in an electronic counter. As the shank continues to move upwardly, the bottom edge of the notch will generate an end-of-count signal which will terminate the count in the electronic counter. The time increment defined by the count is inversely proportional to the "near terminal velocity" of the hammer.

11 Claims, 9 Drawing Figures

METHOD AND APPARATUS FOR MEASURING THE DYNAMICS OF A PIANO PERFORMANCE

This invention relates to measuring systems and more particularly to an improved method and apparatus for measuring the dynamics of a piano performance.

BACKGROUND OF THE INVENTION

In order to record a piano performance and reproduce it mechanically; that is, by re-creating the performance on a piano by mechanical means, it is essential to measure the dynamics of the performance with a high degree of accuracy. Ideally, the method used for measuring the dynamics should yield an independent dynamic value for each note that is played. In addition, the method should not alter the "feel" of the piano in any way, and should be highly reliable. These requirements are met by employing non-contacting sensing of "near terminal hammer velocity."

With respect to the foregoing, true terminal hammer velocity is defined as the linear velocity of the hammer at the instant it collides with the string. Such true terminal hammer velocity is difficult to measure. However, it can be approximated very closely by the average hammer velocity measured over a small displacement of the hammer, just prior to the point of impact. The term "near terminal hammer velocity" is given to this approximation to true terminal hammer velocity.

The foregoing experimental result is explained by three facts:

First, an escapement within the piano action releases a hammer from its actuating mechanism a short distance before the hammer impacts the string, so that the hammer is in free flight, subject only to the influences of gravity and friction, before it hits the string. In a properly regulated grand piano, this free flight starts approximately three millimeters before impact with the string.

Second, as the hammer approaches let-off (as the escapement point is called) the mechanical advantage between key and hammer decreases gradually, making it increasingly difficult to accelerate the hammer.

Third, a human pianist is incapable of large accelerations in his arms and fingers. He achieves high velocities by accelerating a hammer throughout its stroke, or by attacking the key from a large height, which accelerates the hammer early in the stroke.

While systems have been proposed for attempting to measure the hammer velocities and thus provide a measurement of the dynamics of a piano performance, they often require radical modification of the particular piano involved; for example, a complete relocation of the various piano playing components relative to the strings in order to accommodate the necessary mechanism to make the measurements in question. Further, there is great risk in many devices in altering the "feel" of the piano when attempting to measure individually the velocity of the hammer associated with each note played.

BRIEF DESCRIPTION OF THE PRESENT INVENTION

The present invention contemplates a vastly improved method and apparatus for measuring the dynamics of a piano performance wherein: (1) the piano playing components need not be relocated or repositioned relative to the strings; and (2) the "feel" of the piano is substantially unaltered when the measurements are taking place.

In accord with the basic method of the invention, a separate shutter means is provided for each hammer shank of the piano. Cooperating with the separate shutter means is a separate optical switch assembly and separate electronic counter means for each optical switch assembly. The counter means is responsive to an initiating signal from the optical switch assembly to start a count and to an end-of-count signal from the optical switch assembly to terminate the count, the total count defining a time increment. Longitudinal slots are formed in each of the hammer shanks lying in the respective planes of motion of the shanks for securing appropriate shutter means in the slots at given adjustable distances from the corresponding optical assemblies. The arrangement is such that the shutter means will intercept light in the optical assemblies to generate the initiating and end-of-count signals when the corresponding note for the hammer shank is played. The total count registered comprises a digital signal constituting an inverse function of the near terminal hammer velocity.

Accordingly, the dynamics of a piano performance can be measured by recording the digital signals for each note played as determined by the shutter means extending from the top sides of the hammer shanks under the pin block without having to lower the hammer shanks and cooperating piano action components further than their normal positions from the piano strings.

Important features of this invention reside in the manner in which the shutters are secured to the hammer shanks and also in the concept of excavating the underside of the piano pin block to accomodate the optical switch assemblies in appropriate positions for cooperation with shutters held in the hammer shanks.

BRIEF DESCRIPTION OF THE DRAWINGS

A better understanding of this invention as well as further features and advantages thereof will be had by now referring to the accompanying drawings in which.

DETAILED DESCRIPTION OF THE INVENTION

Figure 1:
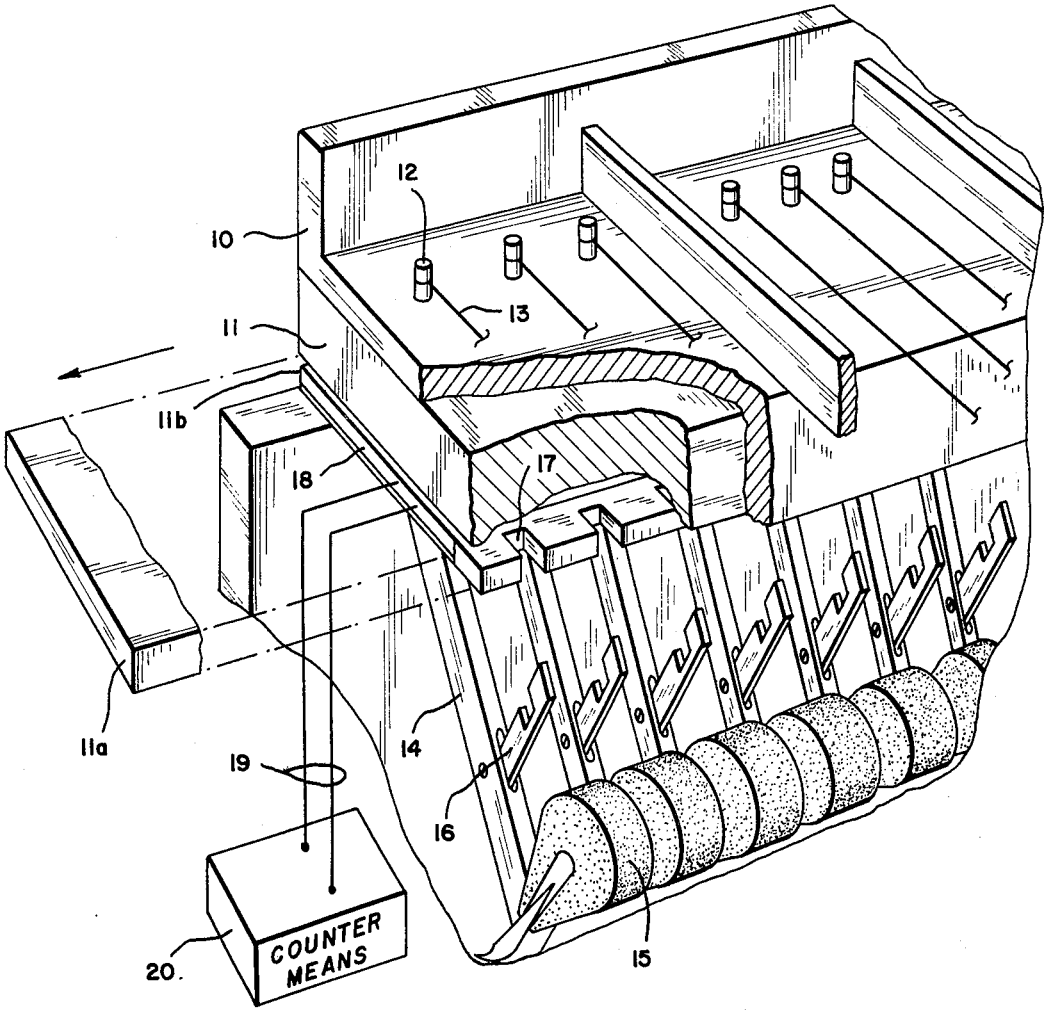
FIG. 1 is a fragmentary perspective view partly broken away of a portion of a piano wherein the apparatus for measuring the dynamics of a performance played on the piano is shown.

Referring first to FIG. 1, there is shown the fragmentary portion of a piano including the piano harp 10 beneath which there is secured the piano pin block 11. Appropriate tuning pins project upwardly through the harp 10 from the pin block 11 to which the piano strings are secured. One such pin is illustrated at 12 for piano string 13.

Appropriate piano action components for each note include a hammer shank 14 supporting a hammer 15 arranged to strike an appropriately positioned piano string when the note is played.

In accord with an important feature of this invention, there are provided individual shutter means carried by the hammer shanks respectively so as to extend upwardly from the shanks. For example, one such shutter means is indicated at 16 for the hammer shank 14.

Cooperating with the shutter means are individual optical switch assemblies each made up, for example, of a light source and photo cell and designated generally by the numeral 17 in FIG. 1. The arrangement is such that the shutter 16 will pass upwardly through the optical switch 17 without any physical engagement therewith but only in a manner to intercept a light beam from a light source to a photo cell.

In order that the shutter 16 can be provided in the manner described to project from the upper sides of the hammer shanks and cooperate properly with the optical switch assemblies, it is necessary that there be sufficient space under or adjacent the pin block 11 to provide sufficient room for the optical switch assemblies and associated electronic circuits. Such associated electronic circuits are in the form of a printed circuit board illustrated at 18. In the embodiment illustrated, the under portion of the pin block 11 has been excavated away and is schematically illustrated by the fragmentary portion 11*a* shown to the left of FIG. 1.

The foregoing feature of excavating the pin block 11 to accommodate the optical switch assemblies is important and constitutes an unobvious modification enabling a successful cooperation of the components of the present invention to be realized in those majority of instances where the pin block interferes. Heretofore, it has been thought in the art that any tampering with the pin block 11 would, in some manner, "ruin" the quality of the piano. Actually, I have discovered that the under portion of the pin block can be removed sufficiently to provide the necessary space for the optical assemblies of my invention without in any way affecting the quality of the piano.

The signals from the optical switch assembly 17 are appropriately buffered in the printed circuit 18 and passed by way of leads indicated schematically at 19 to appropriate counter means 20. It should be understood that there is provided a counter means for each optical assembly and thus one for each note of the piano. Only one of the counter means is shown at 20 to avoid obscuring the drawing.

Figure 2:
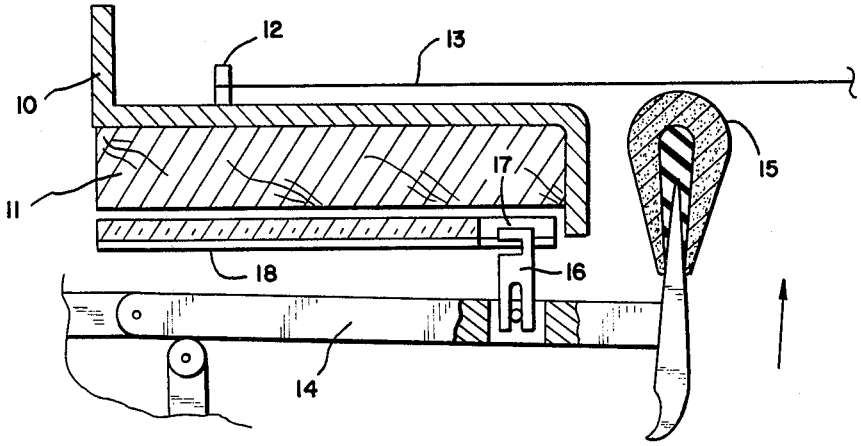
FIG. 2 is a fragmentary side view partly in cross section of the portion of the piano illustrated in FIG. 1.

The above-described arrangement can better be understood with reference to the fragmentary cross section of FIG. 2 wherein the hammer shank 14 is shown as it is moving upwardly towards the string 13, just prior to impact with the string 13. In this position, the shutter 16 is adjusted to extend from the shank 14 so that its top edge will intercept the light beam in the optical switch 17, further upward movement of the shank 14 resulting in the bottom of a notch formed in the shutter intercepting the light beam to generate an end-of-count signal. By measuring the time increment between the initiating signal and end-of-count signal and knowing precisely the distance between the top of the shutter and the bottom of the notch formed in the shutter 16, it is possible to calculate the "near terminal velocity" to a high degree of accuracy.

Figure 3:
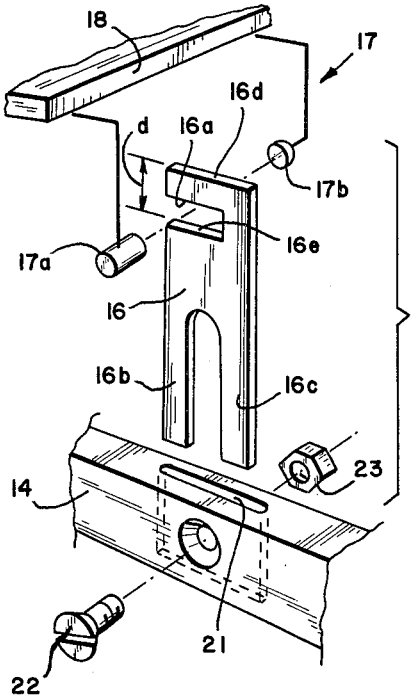
FIG. 3 is an exploded perspective view of a preferred shutter component making up part of the apparatus of this invention.
Figure 4:
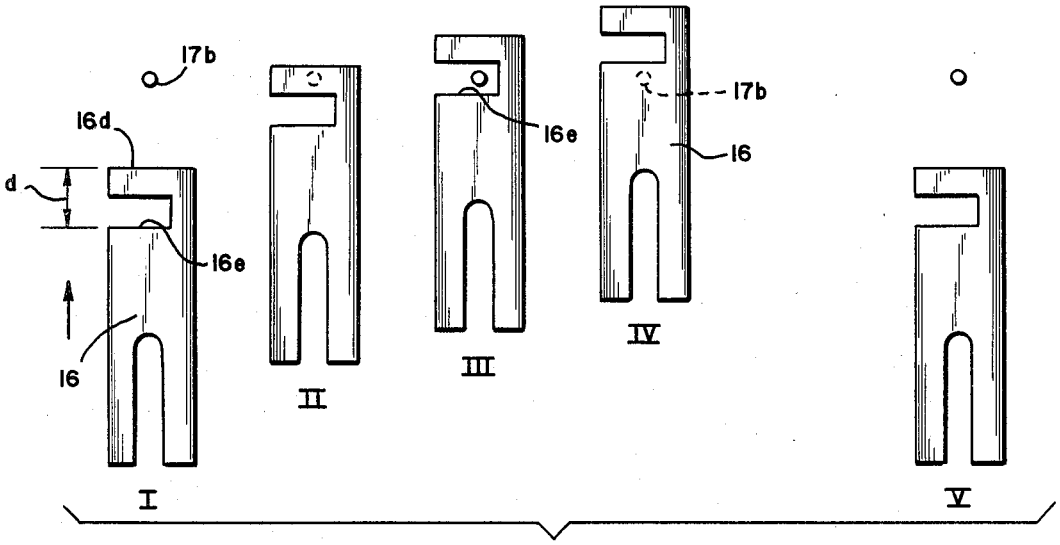
FIG. 4 is a series of diagrams showing successive positions of the shutter of FIG. 3 during the playing of a note.
Figure 5:
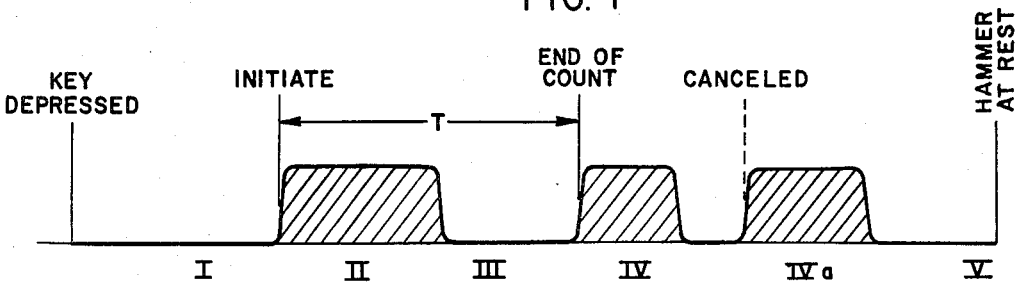
FIG. 5 is a wave form representing an electrical signal from which initiating and end-of-count signals are derived, all resulting from the movement of the shutter depicted in FIG. 4.

All of the above will be better understood with reference to FIGS. 3, 4 and 5 illustrating the preferred embodiment of the shutter means and optical switch assembly of this invention.

Referring first to FIG. 3, it will be noted that the hammer shank 14 is modified by providing a longitudinal slot 21 passing from top to bottom in a portion of the shank close to the hammer and lying in the plane of movement of the shank. The shutter means 16 includes a shutter element having the described transverse notch 16*a* adjacent to its upper end. The lower end of the shutter element terminates in spaced legs 16*b* and 16*c* receivable in the slot 21. Appropriate screw means 22 is arranged to pass transversely through the slot 21 between the legs to receive nut 23 and thereby secure the shutter element in the slot in a desired vertical position.

The top of the shutter designated 16*d* will first intercept light in the optical switch assembly 17, this light being provided by a light source 17*a* projecting a beam of light horizontally to a photo cell 17*b*. The interception of the light by the top 16*d* of the shutter element generates an initiating signal, and continued upward movement of the shank to result in the bottom of the notch 16*e* intercepting the light provides the heretofore referred to end-of-count signal. The distance between the top of the shutter and bottom of the notch is indicated by the letter d and this distance divided by the time increment measured in the counter means 20 as described in FIG. 1 serves to define the "near terminal hammer velocity."

FIG. 4 schematically depicts five positions of the shutter element 16 during the playing of a note. In position I the top edge 16*d* of the shutter is below the photo cell 17*b* so that the light is unblocked. In position II, the light is intercepted and thus blocked by the top portion of the shutter from reaching the photo cell 17*b*. In position III, the notch again exposes the photo cell 17*b* to light, and in the position IV the bottom edge 16*e* of the notch has intercepted and again blocked the light from reaching the photo cell 17*b*. Position IV represents the position of the shutter at the instant the hammer strikes the string.

After the string has been hit by the hammer, the hammer rebounds along with the shank and the shutter 16 moves downwardly to a rest position designated by position V.

FIG. 5 illustrates diagrammatically the output signal from the photo cell during each of the above-described five positions as a function of time. Thus, referring to the left portion of FIG. 5 when a piano key is initially depressed the hammer shank starts upwardly and the shutter assumes the position illustrated at I. With the photo cell 17 being exposed to light, there is no output signal. However, when interception of the light beam takes place by the top edge 16*d* of the shutter, there is a signal generated for a length of time corresponding to the length of time that the photo cell 17*b* is blocked. This is shown at II in FIG. 5. The leading edge of the signal is used to generate an initiating signal to the counter means.

Still referring to FIG. 5, position III between the end of the time the photo cell is blocked and the interception of the lower edge of the notch with the photo cell is depicted as an open area while the signal at position IV corresponds to the blockage of the photo cell after the lower edge of notch 16*b* has intercepted the light. The extent of this blockage is somewhat shorter than the first pulse illustrated in FIG. 5 because the light is blocked only while the hammer is impacting the string, and unblocked as soon as the hammer rebounds to move the shutter downwardly and thus expose the photo cell 17*b* through the notch. The pulse at position IVa results when the notch permits light to pass through and then is again blocked. The hammer at rest position is illustrated to the extreme right of the time diagram of FIG. 5.

By generating a signal only in response to a rise in the wave forms depicted in FIG. 5, the proper initiating and end-of-count signals can be provided. However, it is necessary to cancel the spurious signal generated when the shutter moves to its rest position. Such cancellation can be achieved electronically.

The time increment during which the counter is operated is indicated by the letter T in FIG. 5 between the leading edges of the pulses defining the beginning of the positions II and IV and as stated, the distance d divided by this time increment provides the near terminal velocity to be measured.

Figure 6:
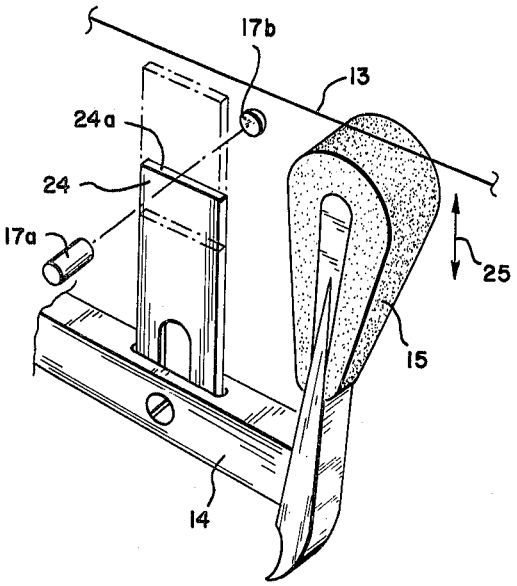
FIG. 6 is a fragmentary perspective view of a relatively inaccurate yet possible manner of making a dynamic measurement for a single note utilizing many of the components making up the preferred embodiment.

FIG. 6 shows an alternative arrangement wherein rather than utilizing a notched shutter, a solid shutter is used at 24 with only the top edge 24*a* being used to generate the initiating and end-of-count signals. In this instance, there is generated the initiating signal when the top edge 24*a* initially intercepts the light beam from the source 17*a* to the photo cell 17*b*. The end-of-count signal, on the other hand, is generated by the trailing edge of the pulse rather than the leading edge of the next pulse as described in the case of the notch. The trailing edge of the pulse is generated when the shutter returns to a position below the light beam after the hammer 15 has struck the string 13. The time interval measured is thus much longer and is not over a specified given distance d as in the case described in FIGS. 4 and 5. On the other hand, there is only required a starting of the counter at the leading edge of the signal generating by the shutter on its up stroke and a termination of the count by an end-of-count signal generated by the shutter when it returns and unblocks the light. While a near terminal velocity can be derived from the time interval measured in this manner, it is not nearly as accurate as the system described in FIGS. 4 and 5 and thus does not constitute applicant's preferred embodiment.

Figure 7:
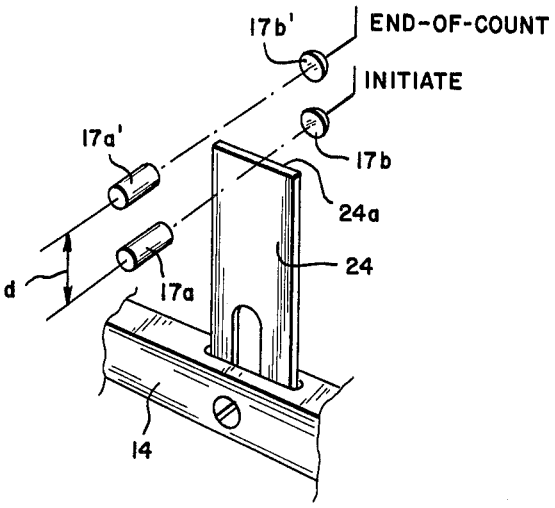
FIG. 7 is a fragmentary perspective view of a modified type of optical assembly usable with a modified shutter for making the measurements in accord with the present invention.

FIG. 7 shows another manner of providing an initiating and end-of-count signal in a wholly unambiguous manner. In this arrangement, each of the optical assemblies includes first and second optical switches provided at, for example, 17*a* and 17*b* for the first optical switch and 17*a'* and 17*b'* for the second optical switch. The second optical switch is disposed vertically above the first optical switch a given distance d.

With this arrangement, and using the same shutter 24 described in FIG. 6, the top edge 24*a* will generate the initiating signal when it intercepts the first optical switch 17*a*, 17*b*. After the hammer shank continues to move upwardly to the distance d, the top edge 24*a* will intercept the second optical switch 17*a'*, 17*b'* to provide a signal which can be used as an end-of-count signal. Again the time increment between the two signals when divided into the distance d provides the near terminal velocity. The system of FIG. 7 avoids the necessity of discriminating between various different signals since the initiating and end-of-count signals are derived from specific separate sources.

Figure 8:
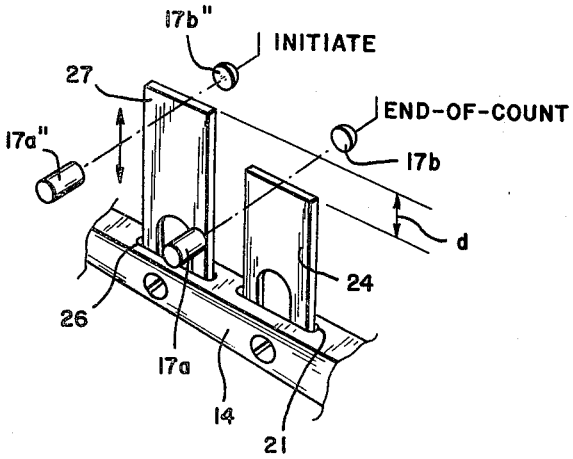
FIG. 8 is a fragmentary perspective view of yet another embodiment utilizing two separate shutters for each hammer shank together with a modified optical switch assembly; and, FIG. 9 is a fragmentary perspective view of a stepped shutter which can be utilized as a substitute for the two shutters described in the embodiment of FIG. 8.

FIG. 8 shows yet another means of generating the initiating and end-of-count signals wherein the hammer shank 14 is modified by providing first and second longitudinal slots one in front of the other as indicated at 21 and 26 passing from top to bottom in a portion of the shank close to the hammer and lying in the plane of motion of the shank. The shutter means includes first and second shutter elements 24 and 27 each having lower separated legs receivable in the first and second slots, respectively. These shutter elements are secured by appropriate screw means as shown. The optical switch assembly includes first and second optical switches positioned respectively above the first and second shutters as indicated at 17*a* and 17*b* and at 17*a''* and 17*b''*. It should be understood that these two optical switches are at the same horizontal level and are positioned one in front of the other as opposed to vertical stacking as in FIG. 7.

As shown in FIG. 8, the spacing of the first shutter element 24 from the first optical switch is greater by a given distance d than the spacing of the second shutter element 27 from the second optical switch 17*a''*, 17*b''*. As a consequence, the second shutter 27 will intercept the second optical switch to provide the initiating signal and after the distance d has been traversed, then the first shutter element will intercept the first optical switch to provide the end-of-count signal.

Figure 9:
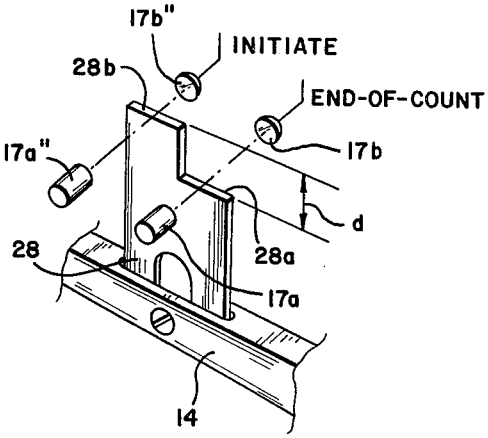

Finally, FIG. 9 shows a functionally equivalent shutter and hammer shank arrangement to that described in FIG. 8 except that a single stepped shutter is utilized rather than the two separate shutters shown in FIG. 8.

Thus, in FIG. 9 there is shown a single shutter 28 having stepped top edges 28*a* and 28*b* for cooperation with first and second optical switches 17*a*, 17*b* and 17*a''*, 17*b''* horizontally positioned in spaced relationship as shown in FIG. 8. In FIG. 9, when the shank 14 moves upwardly, the higher stepped portion 28*b* will first intercept the second optical switch 17*a''*, 17*b''* to generate the initiating signal and after a distance d has been traversed, then the lower stepped portion 28*a* intercepts the first optical switch 17*a*, 17*b* to provide the end-of-count signal.

The use of two shutters as described in FIG. 8 will permit an adjustment of the distance d over which a count is to be made by simply varying the vertical height of one of the shutters with respect to the other. The single shutter of FIG. 9 has an advantage in that it requires only a single slot in the hammer shank 14 and can be made somewhat more compact and with less mass than two separate shutters. On the other hand, there is not then available the adjustment of the distance d.

While the various alternative arrangements illustrated in FIGS. 6, 7, 8 and 9 can be used in various situations, the preferred arrangement is that described in FIGS. 3, 4 and 5.

As mentioned heretofore, an important feature of this invention when applied to conventional pianos is applicant's discovery that the underside of the pin block can be excavated without in any serious way affecting the quality of the piano. Accordingly, sufficient room can be provided to accommodate the optical switch assembly so that the shutters can be positioned on the hammer shanks without having to lower the hammer shanks and cooperating piano action components further than their normal positions from the piano strings.

Where new pianos are to be designed and manufactured, the pin block can initially be properly sized to provide the necessary space. Further, for certain types of pianos, the pin block may be of such dimensions that excavation is not necessary.

While the term "shutter notch" is meant to include the notched shutter shown in the drawings, it is clear that an equivalent "notch" can be provided in the shutter in the form of a window. In other words, an opening or window can replace the notch, it only being necessary to expose and then eclipse the light beam a second time as the shutter moves upwardly. The term "notch" is thus intended herein to cover any equivalent opening or window in the shutter element.

I claim:

1. A method of measuring the dynamics of a piano performance including the steps of:

(a) providing a separate shutter means for each hammer shank of said piano;

(b) providing a separate optical switch assembly for cooperation with said shutter means;

(c) providing a separate electronic counter means for each optical switch assembly, said counter means being responsive to an initiating signal from said optical switch assembly to start a count and to an end-of-count signal from said optical switch assembly to terminate said count, the total count defining a time increment;

(d) forming longitudinal slots through said hammer shanks lying in the respective planes of motion of the shanks; and (e) securing said shutter means in said slots at given adjustable spacings from said optical assemblies such that said shutter means will intercept light in said optical assemblies to generate said initiating and end-of-count signals when the corresponding note for said hammer shank is played, the total count registered comprising a digital signal constituting an inverse function of the near terminal hammer velocity whereby the dynamics of a piano performance can be measured by recording the digital signals for each note played as determined by the shutter means extending from the top sides of the hammer shanks.

2. The method of claim 1, including the step of providing a notch in a shutter element for each of said shutter means, the element being positioned so that the top of the shutter element intercepts the light to provide said initiating signal and thence as said shank continues its movement unblocks the light of the notch until the bottom of the notch intercepts the light to provide said end-of-count signal, the distance between said top of the shutter and bottom of the notch divided by said time increments defining said near terminal hammer velocity.

3. The method of claim 1 including the step of providing a single shutter element for each of said shutter means and including the further step of providing first and second optical switches for each of said optical assemblies, the second positioned above the first by a given distance so that the top edge of said shutter element intercepts the light of the first optical switch to provide said initiating signal and thence as said shank continues its movement, the top edge intercepts said second optical switch to provide said end-of-count signal, said given distance divided by said time increment defining said near terminal hammer velocity.

4. The method of claim 1, including the step of providing first and second shutter elements for each of said shutter means carried in longitudinal alignment in the hammer shank; and including the further step of providing first and second optical switches for each of said optical assemblies, in longitudinal alignment above said first and second shutter elements, and adjusting the spacing of the first shutter element from the first optical switch to be greater by a given distance than the spacing of the second shutter element from the second optical switch so that as said hammer shank moves, the second shutter intercepts light in the second optical switch to provide said initiating signal and as the shank continues to move the first shutter element intercepts the first optical switch to provide said end-of-count signal, said given distance divided by said time increment defining said near terminal hammer velocity.

5. The method of claim 1, including the step of excavating at least a portion of the underside of the pin block of the piano overlying the shutter means to provide room for said optical assemblies without having to lower the hammer shanks and cooperating piano action components further than their normal positions from the piano strings.

6. An apparatus for measuring the dynamics of a piano performance on a piano wherein the hammer shanks of the piano are normally disposed a given spacing below the piano pin block, including, in combination:

(a) individual shutter means carried by said hammer shanks respectively so as to extend upwardly from said shanks;

(b) individual optical switch assemblies for cooperation with said individual shutter means respectively; and, (c) individual electronic counter means for each of the optical switch assemblies, respectively and responsive to an initiating signal from said optical switch assembly to start a count and to an end-of-count signal from said optical switch assembly to terminate said count, the total count defining a time increment, the relative spacing between the shutter means and optical switch assemblies being such that the shutter means intercepts light in the optical switch assemblies to generate said initiating and end-of-count signals when the corresponding note for said hammer shank is played, the total count registered comprising a digital signal constituting an inverse function of the near terminal hammer velocity, whereby the dynamics of each note played in said piano performance are defined by an associated digital signal.

7. An apparatus according to claim 6, in which each hammer shank is modified by providing a longitudinal slot passing from top to bottom in a portion of the shank close to the hammer and lying in the plane of movement of the shank, said shutter means including a shutter element having a transverse notch adjacent to its upper end and its lower end terminating in spaced legs receivable in the slot; and screw means passing transversely through the slot between the legs for securing the shutter in said slot in a desired vertical position, the top of the shutter element intercepting the light in the optical switch assembly to provide said initiating signal and the bottom of the notch intercepting the light as the shank continues to move to provide said end-of-count signal, the distance between the top of the shutter and bottom of the notch divided by said time increment defining said near terminal hammer velocity.

8. An apparatus according to claim 6, in which each hammer shank is modified by providing a longitudinal slot passing from top to bottom in a portion of the shank close to the hammer and lying in the plane of motion of the shank, said shutter means including a shutter element with lower separated legs receivable in the slot; screw means passing transversely through the slot between the legs for securing the shutter element in said slot, said optical switch assembly including first and second optical switches, the second positioned above the first by a given distance so that the top edge of said shutter element intercepts the light of the first optical switch to provide said initiating signal and thence as said shank continues its movement the top edge intercepts said second optical switch to provide said end-of-count signal, said given distance divided by said time increment defining said nearly terminal hammer velocity.

9. An apparatus according to claim 6, in which each hammer shank is modified by providing first and second longitudinal slots one in front of the other passing from top to bottom in a portion of the shank close to the hammer and lying in the plane of motion of the shank, said shutter means including first and second shutter elements each having lower separated legs receivable in said first and second slots, respectively; screw means passing transversely through the first and second slots between the shutter legs for holding the shutters in the slots respectively, in desired set vertical positions; said optical switch assembly including first and second optical switches positioned respectively above said first and second shutters, the spacing of the first shutter element from the first optical switch being greater by a given distance than the spacing of the second shutter element from the second optical switch so that as the hammer shank moves, the second shutter intercepts light in the second optical switch to provide said initiating signal and as the shank continues to move the first shutter intercepts the first optical switch to provide said end-of-count signal, said given distance divided by said time increment defining said nearly terminal hammer velocity.

10. An apparatus according to claim 6, in which each hammer shank is modified by providing an elongated longitudinal slot passing from top to bottom in a portion of the shank close to the hammer and lying in the plane of motion of the shank, said shutter means including a single shutter element having a stepped top edge to define first and second shutter portions the lower portion of the shutter having separated legs receivable in said elongated slot; screw means passing transversely through the slot between the shutter legs for holding the shutter in the slot; said optical switch assembly including first and second optical switches positioned respectively above the first and second shutter portions, the spacing of the top edge of the first shutter portion from the first optical switch being greater by a given distance than the spacing of the top edge of the second shutter portion from the second optical switch so that as the hammer shank moves, the second shutter portion intercepts light in the second optical switch to provide said initiating signal and as the shank continues to move the first shutter portion intercepts the first optical switch to provide said end-of-count signal, said given distance divided by said time increment defining said nearly terminal hammer velocity.

11. An apparatus according to claim 6, including a modified piano pin block corresponding to the normal piano pin block except for an under portion excavated from the block to increase said given spacing to thereby accommodate said optical switch assemblies without changing the normal position of the piano action components relative to the piano strings.

* * * * *